US006554143B1

(12) United States Patent
Robertson

(10) Patent No.: US 6,554,143 B1
(45) Date of Patent: Apr. 29, 2003

(54) DISPLAY SHELF HAVING ANTI-ROTATION RAILINGS

(75) Inventor: James David Robertson, Atlanta, GA (US)

(73) Assignee: Display Industries, LLC., Smyrna, GA (US)

( * ) Notice: Subject to any disclaimer, the term of this patent is extended or adjusted under 35 U.S.C. 154(b) by 0 days.

(21) Appl. No.: 10/098,231

(22) Filed: Mar. 15, 2002

Related U.S. Application Data

(63) Continuation of application No. 09/878,639, filed on Jun. 11, 2001, now Pat. No. 6,398,044, which is a continuation of application No. 08/941,957, filed on Oct. 1, 1997, now abandoned.

(51) Int. Cl.[7] ..... A47F 1/04
(52) U.S. Cl. ..... 211/59.2; 211/74
(58) Field of Search ..... 211/187–188, 59.2, 211/59.3, 74, 135, 151, 153, 184, 186; 108/108; D19/517, 520, 550; 206/446, 459.5, 775; 312/42, 45, 72; 221/27, 29, 151, 152, 156

(56) References Cited

U.S. PATENT DOCUMENTS

| | | | | | |
|---|---|---|---|---|---|
| 2,649,207 | A | * | 8/1953 | Shield | 211/59.2 |
| 3,499,539 | A | * | 3/1970 | Fisher | 211/162 |
| 4,042,096 | A | * | 8/1977 | Smith | 211/134 |
| 4,105,126 | A | * | 8/1978 | Deffner et al. | 211/59.2 |
| 4,239,099 | A | * | 12/1980 | Williams et al. | 193/32 |
| 4,294,363 | A | * | 10/1981 | Oztekin et al. | 193/38 |
| 4,314,648 | A | * | 2/1982 | Spamer | 193/2 R |
| 4,478,337 | A | | 10/1984 | Flum | |
| 4,630,739 | A | | 12/1986 | Levenberg | 211/189 |
| 4,685,574 | A | | 8/1987 | Young et al. | 211/59.2 |
| 4,724,968 | A | | 2/1988 | Wombacher | 211/59.3 |
| 4,730,741 | A | | 3/1988 | Jackle, III et al. | 211/59.3 |
| 4,762,236 | A | | 8/1988 | Jackle, III et al. | 211/59.3 |
| 4,785,943 | A | * | 11/1988 | Deffner et al. | 211/128.1 |
| 4,785,945 | A | | 11/1988 | Rowse et al. | 211/59.2 |
| 4,836,390 | A | | 6/1989 | Polvere | 211/59.3 |
| 4,901,869 | A | * | 2/1990 | Hawkinson et al. | 211/184 |
| 4,923,070 | A | * | 5/1990 | Jackle et al. | 211/126.1 |
| 4,958,739 | A | | 9/1990 | Spamer | 211/59.2 X |
| 4,997,094 | A | | 3/1991 | Spamer et al. | 211/153 |
| 5,022,535 | A | * | 6/1991 | Spamer | 211/187 |
| 5,024,336 | A | | 6/1991 | Spamer | 211/59.2 |
| 5,050,748 | A | | 9/1991 | Taub | 211/59.2 |
| 5,097,962 | A | * | 3/1992 | Eklof et al. | 211/184 |
| 5,160,051 | A | | 11/1992 | Bustos | 211/59.2 |
| 5,197,610 | A | * | 3/1993 | Bustos | 211/150 |
| 5,203,463 | A | | 4/1993 | Gold | 211/59.3 |
| 5,240,126 | A | | 8/1993 | Foster et al. | 211/59.3 |
| 5,314,081 | A | | 5/1994 | Carroll | 211/184 |
| 5,351,838 | A | | 10/1994 | Flum | 211/59.2 |
| 5,458,248 | A | | 10/1995 | Alain | 211/175 |
| 5,531,336 | A | | 7/1996 | Parham et al. | 211/183 |
| 5,542,552 | A | | 8/1996 | Yablans et al. | 211/59.3 |
| 5,562,217 | A | | 10/1996 | Salveson et al. | 211/51 X |
| 5,595,310 | A | | 1/1997 | Spamer et al. | 211/74 X |
| 5,614,288 | A | * | 3/1997 | Bustos | 211/59.2 |

(List continued on next page.)

*Primary Examiner*—Daniel P. Stodola
*Assistant Examiner*—Jennifer E. Novosad
(74) *Attorney, Agent, or Firm*—John L. James

(57) ABSTRACT

An elongate channel displays a row of articles such as cans and bottles having petaloid feet. The channel is designed to receive petaloid feet articles for sliding movement along its length. The channel comprises a base wall and at least one side wall upstanding from one of the opposite side edges of the base wall. The base wall comprises a plurality of upwardly projecting ribs extending along the channel. The tops of the ribs define a plane on which the petaloid feet of articles are to be disposed. The base wall further comprises a pair of railings disposed along the plane and extending along the channel. The railings define therebetween a groove for receiving at least one of the petaloid feet of each article.

2 Claims, 7 Drawing Sheets

U.S. PATENT DOCUMENTS

| | | | | |
|---|---|---|---|---|
| 5,634,564 | A | | 6/1997 | Spamer et al. ..... 211/175 X |
| 5,645,176 | A | | 7/1997 | Jay ..... 211/59.2 |
| 5,665,304 | A | | 9/1997 | Heinen et al. ..... 211/59.3 X |
| 5,685,664 | A | | 11/1997 | Parham et al. ..... 211/59.3 X |
| 5,695,074 | A | | 12/1997 | Wiese ..... 211/59.2 |
| 5,788,090 | A | | 8/1998 | Kajiwara ..... 211/59.2 |
| 5,806,689 | A | * | 9/1998 | Mays et al. ..... 108/108 |
| 5,826,400 | A | * | 10/1998 | Martin et al. ..... 211/59.2 |
| 5,992,650 | A | | 11/1999 | Lord ..... 211/59.2 |
| 6,398,044 | B1 | * | 6/2002 | Robertson ..... 211/59.2 |

* cited by examiner

DISPLAY SHELF HAVING ANTI-ROTATION RAILINGS

CROSS-REFERENCE TO RELATED APPLICATIONS

This application is a continuation of Ser. No. 09/878,639 filed Jun. 11, 2001, now U.S. Pat. No. 6,398,044, which is a continuation of Ser. No. 08/941,957 filed Oct. 1, 1997, now abandoned.

BACKGROUND OF THE INVENTION

This invention relates to a display device useful in merchandising articles having petaloid feet, and more particularly to a shelf device having an elongate channel for receiving petaloid articles for sliding movement therealong. The display channel of the invention has anti-rotation means for engagement with at least one of the petaloid feet of each article. The anti-rotation means enhances the appearance of the articles in the channel by retaining the articles at a predetermined orientation during their movement along the channel.

Display shelf devices with article-dispensing channels have been used in the merchandising of a number of products. The channels, typically, are supported on a shelf in a tilted condition and receive articles in rows so that the received articles slide or gravity feed one after another to the fronts of the channels as the leading articles in each row are removed from the respective channel. Shelf devices with conventional dispensing channels are disclosed. for example, in U.S. Pat. Nos. 4,239,099; 4,314,648; and 4,496,037 which are owned by the assignee of the present invention.

While such conventional channels have experienced considerable success, they are not without disadvantages. Because the majority of commercial bottles and cans have cylindrical bodies, it is difficult to arrange bottles or cans on the channels at a predetermined orientation. More particularly, cylindrical articles tend to be placed on the channels at a random orientation and even to slowly rotate about their upright axes during their sliding movement along the channels. This results in the labels or the logos on the articles facing in different directions, which detracts from the appearance of the displayed articles.

What is needed, therefore, is an improved display channel which enhances the appearance of the articles displayed thereon.

SUMMARY OF THE INVENTION

In meeting the foregoing needs, the present invention provides an elongate display channel for receiving a row of articles for sliding movement therealong. The channel comprises a base wall having opposite side edges and at least one side wall upstanding from one of the side edges of the base wall. The base wall comprises means for defining a plane on which the bottoms of articles are to be placed, and a pair of railings disposed along the plane and extending along the channel. The railings define therebetween a groove for receiving the respective portions of the bottoms of articles. The railings have tops disposed above the plane.

In the channel of the invention, the groove can receive the portions of articles. This assists in the loading of articles with their labels or logos facing in a predetermined direction. The railings engage the portions of the loaded articles during movement of the articles along the channel. This prevents rotational movement of the articles about their upright axes, which keeps the articles arranged at a certain orientation while they are displayed on the channel.

A preferred embodiment of the plane-defining means comprises a plurality of upwardly projecting parallel ribs formed on the base wall along the channel. The ribs may be formed such that the tops of the ribs lie in the plane of floor.

The present invention also provides another form of display channel. This channel is designed to receive a row of upright articles each having petaloid feet. The channel comprises a pair of spaced upstanding side walls, a base wall interconnecting the side walls at their respective lower edges, and anti-rotation means for engagement with at least one of the petaloid feet of each article in the channel so as to maintain the articles in a predetermined orientation during sliding movement of the articles along the channel.

In a preferred embodiment the anti-rotation means comprises a pair of railings disposed on the base wall and extending along the channel. Such railings may define therebetween a groove for receiving at least one of the petaloid feet of each article.

The present invention further provides a display shelf device including a shelf unit having front and rear opposed edges. The shelf unit comprises means for defining a plurality of parallel tracks each extending between the front and rear edges of the unit to receive a row of articles for movement along each track. The track-defining means comprises a floor panel and a plurality of spaced parallel partition walls upstanding from the floor panel and extending between the front and rear edges. Each track is defined by the floor panel and a pair of adjacent partition walls. The floor panel comprises, for each track, means for defining a plane on which the bottoms of articles are to be disposed, and a pair of railings disposed along the plane and extending along each track. The floor panel further comprises a pair of railings defining therebetween a groove for receiving a portion of the bottom of each article. The railings have tops disposed above the plane In a preferred embodiment, the device further comprises support means for supporting the shelf unit so that the shelf unit is inclined downwardly toward its front edge. This allows the articles in each track to gravity feed one after another toward the front edge of the shelf unit as leading articles in each track are removed from each track.

DETAILED DESCRIPTION OF THE PREFERRED EMBODIMENTS

Figure 1:
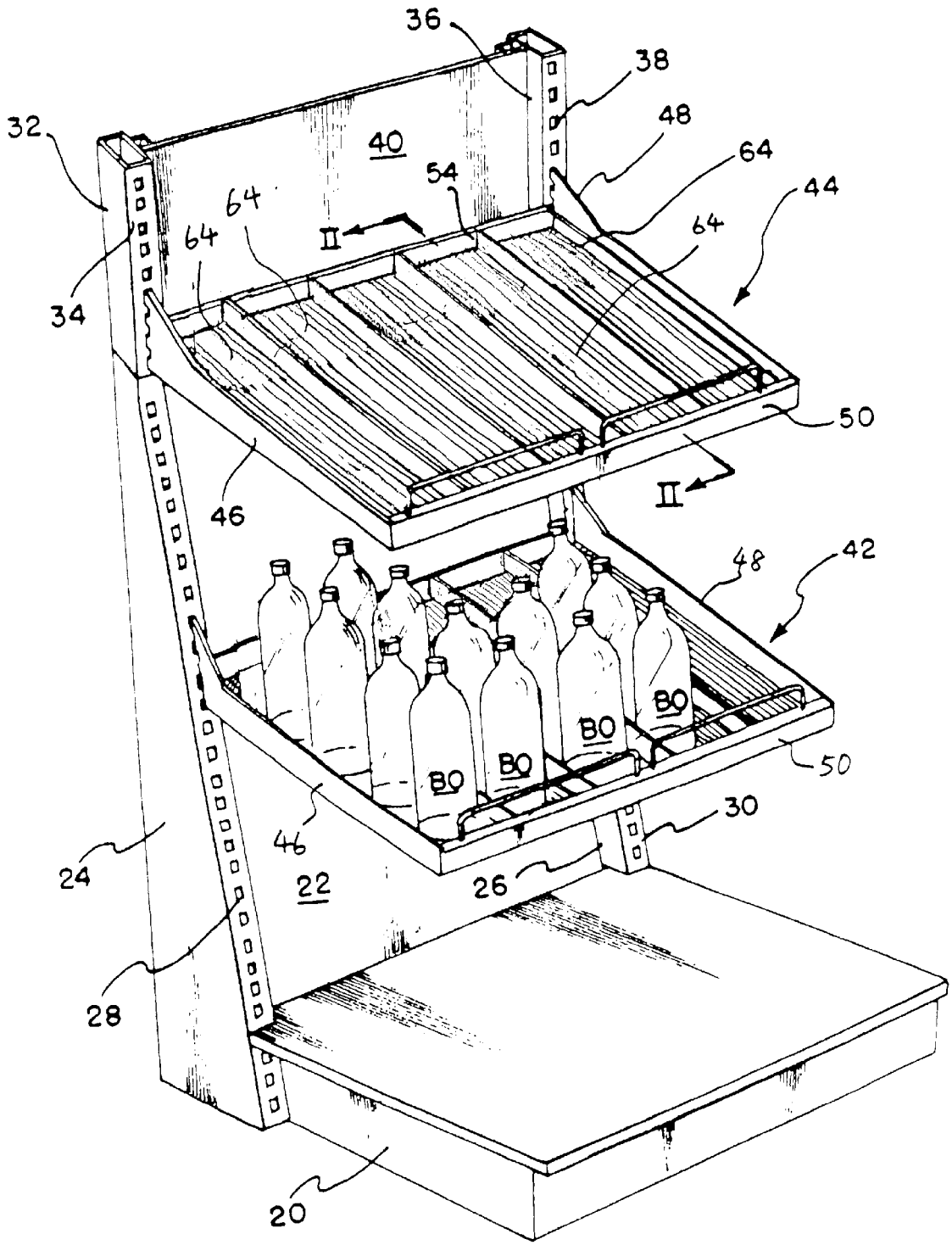
FIG. 1 is a perspective view of a display shelf device according to the present invention.

FIG. 1 shows a gravity feed display shelf device designed to display and merchandise bottled beverages such as soft drinks contained in PET petaloid bottles. The "petaloid bottle" in this application refers to a bottle having at least three (preferably five or six) feet evenly disposed around the longitudinal axis of the bottle and projecting from a generally hemispherical bottom form of the bottle to provide a stable self-standing support.

The illustrated shelf device comprises a base 20 and a lower back panel 22 extending upwardly from the base 20. The back panel 22 is supported by lower post members 24 and 26 having slotted sloping faces 28 and 30, respectively. Secured atop the lower post member 24 is an upper post member 32 having a vertically disposed slotted face 34. Similarly, an upper post member 36 is mounted atop the lower post member 26 and is provided with a slotted vertical face 38. An upper back panel 40 is supported by the upper post members 32 and 36. Shelves generally indicated at 42 and 44 are mounted respectively on the slotted sloping faces 28 and 30 and on the slotted vertical faces 34 and 38.

The shelves 42 and 44 are substantially identical and are supported in substantially parallel relationship to each other on the respective sloping and vertical faces 28, 30, 34 and 38. Engaging tabs on the shelves 42 and 44 cooperate with the slots in the sloping and vertical faces in different ways to detachably connect the shelves to the post members 24, 26, 32 and 36. Thus the shelves 42 and 44 are maintained in parallel relationship by virtue of the fact that the tabs and the angle of the sloping faces of the lower post members 24 and 26 cooperate in such manner as to achieve this result. The manner in which this is accomplished is described in U.S. Pat. No. 3,983,822 issued Oct. 5, 1976, which is hereby incorporated by reference.

Figure 2:
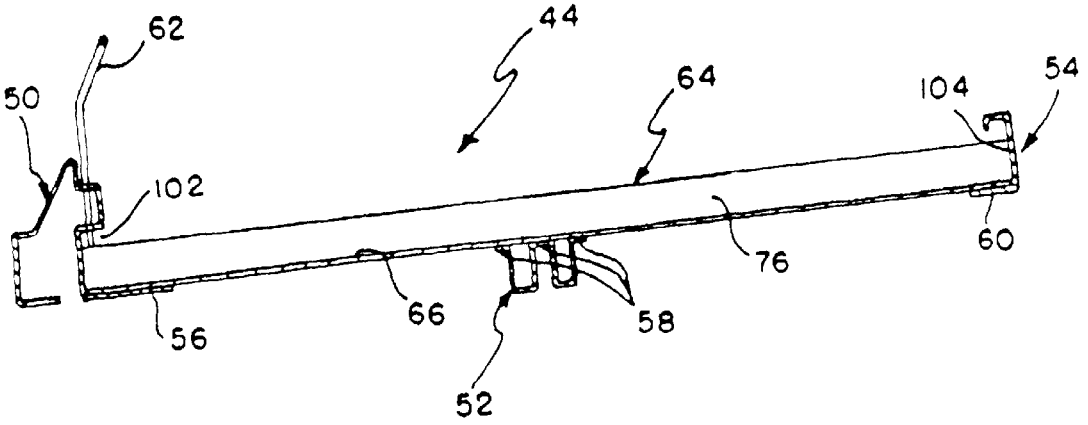
FIG. 2 is a view taken along the line II—II in FIG. 1

As shown in the drawings, each of the shelves such as 42 and 44 comprises support means in the form of a substantially rigid support frame and a plurality of parallel elongate channels 64 placed side by side on the support frame to accommodate and support a number of petaloid bottles. As is best shown in FIGS. 1 and 2, each support frame includes a pair of spaced parallel side elements 46 and 48 extending forward from the respective post members and a set of spaced parallel front, intermediate and rear elements 50, 52 and 54 interconnecting the side elements 46 and 48. The side elements 46 and 48 are provided at their respective rear ends with the aforementioned engaging tabs The elements 50, 52 and 54 include upwardly facing support surfaces 56, 58 and 60, respectively, all disposed in a common plane which is forwardly and downwardly tilted. These surfaces in cooperation support the channels 64 in a tilted fashion. The angle of tilt from the horizontal may vary somewhat but experience has shown that this angle may be about 1 to 20 degrees and preferably about 3.5 to 8 degrees. The angle of tilt in most applications of the invention may be approximately 6 degrees from horizontal.

The front element 50 of the support frame includes stop means in the form of a wire guard 62 which is slotted into the front element 50. This wire guard 62 is a portion on which frontmost/leading bottles on each channel 64 rest, as will be described in more detail.

Figure 3:
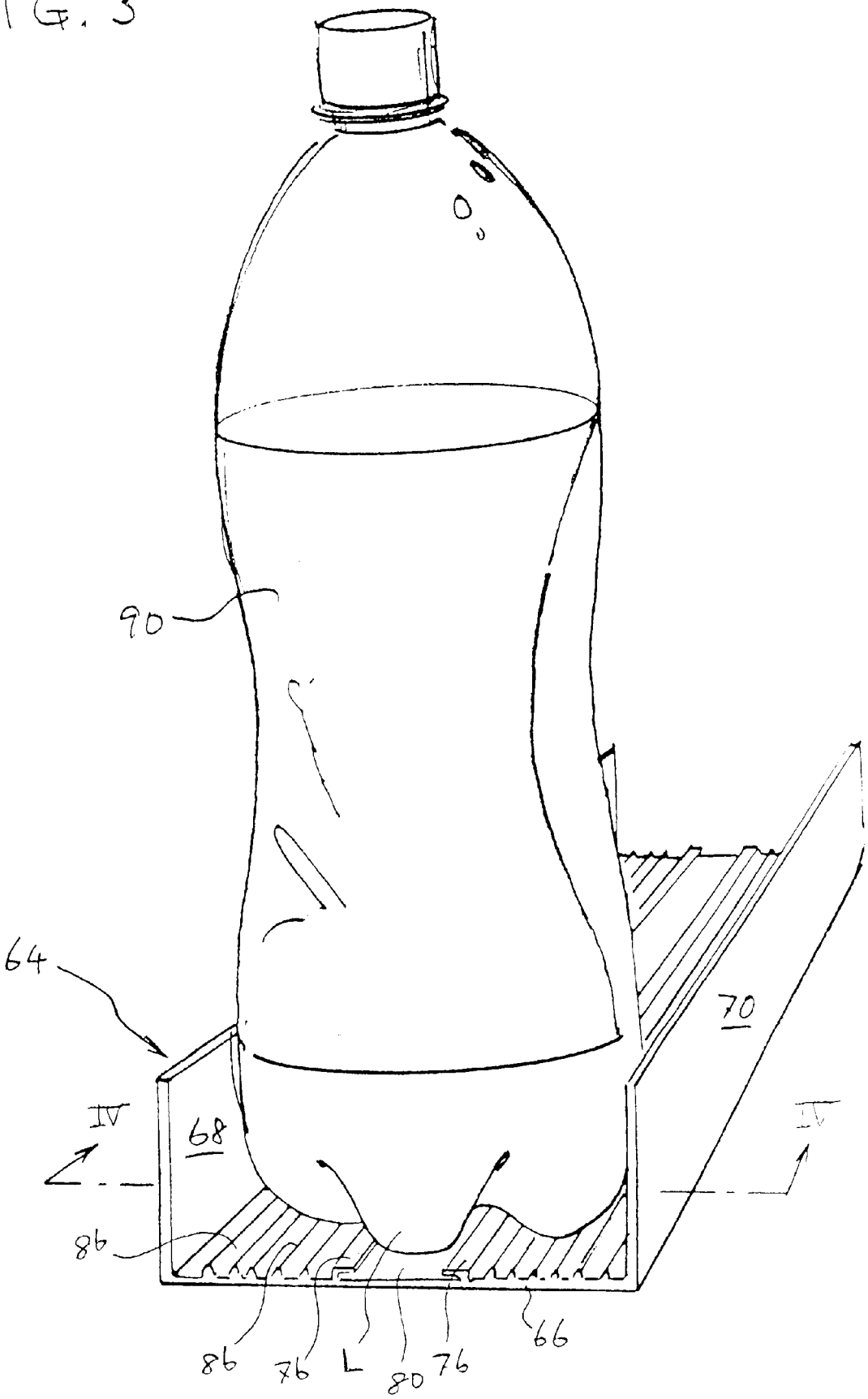
FIG. 3 is a perspective view of one of the channels in the shelf device in FIG. 1, showing a petaloid bottle placed therein.

FIG. 3 illustrates one of the channels 64 in the form separated from the support frame. As all the channels 64 are virtually the same in size and structure, only one channel is described hereinafter. As illustrated, the channel 64 includes a pair of spaced side walls 68 and 70 and a base wall 66 interconnecting the side walls 68 and 70 at their respective lower edges. The channel 64 extends between the front and rear elements 50 and 54 so that a track extending entirely between the front and rear elements 50 and 54 is defined by the side walls 68 and 70 and the base wall 66. The side walls 68 and 70 act as guides for bottles in the channel 64 and cause the bottles placed on the channel 64 to be arranged in a row. The base wall 66 provide a floor on which the bottoms of the bottles are supported.

Figure 4:
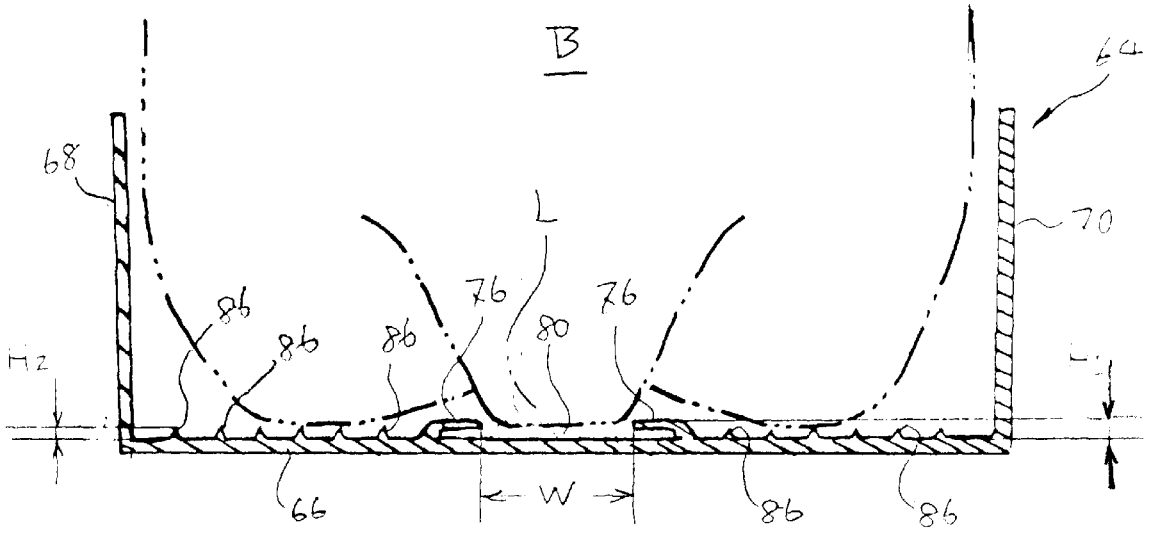
FIG. 4 is a view taken along the line IV—IV in FIG. 3, FIGS. 5 and 6 are cross sections showing variations of the channel in FIG. 4.

In order to minimize friction between the floor of the channel 64 and the bottles to be received therein, a plurality of upwardly projecting parallel ribs 86 are integrally formed with the base wall 66 along the channel 64, as best shown in FIGS. 3 and 4. The ribs 86, preferably, are arranged at equal spacings. Each rib 86 is of a generally triangular cross section. The tops or peak edges of the ribs 86 lie in a common plane on which the petaloid feet of each bottle are to be disposed.

As further shown in FIGS. 3 and 4, the area of the base wall 66 around the midpoint between the side walls 68 and 70 are formed without ribs 86, which leaves a strip of smooth surface on the base wall 66 The smooth surface is bounded by a pair of spaced parallel railings 76 extending along the channel 64. These railings 76 are integrally formed with the base wall 66, project upwardly and are turned inwardly toward each other. In other words, each railing 76 is of a generally L-shaped cross section. A groove 80 is defined between the railings 76, which groove is dimensioned such that one of the petaloid feet of a bottle may be loosely received in the groove. In case of using two-liter petaloid bottles having six feet, the width "W" of the groove 80 or the distance between the railings 76 may be about 18 mm and 35 mm and preferably about 23 mm. The height "H1" of the railings 76 is slightly greater than the height "H2" of the ribs 86 so that the top surfaces of the railings 76 are disposed above the plane. This arrangement allows the bottles on the base wall 66 to engage at their feet with at least one of the railings 76 to resist minor torque exerted on the bottles which would otherwise rotate the bottles about their respective upright longitudinal axes. preferably about 23 mm. The height "H1" of the railings 76 is slightly greater than the height "H2" of the ribs 86 so that the top surfaces of the railings 76 are disposed above the plane of floor. This arrangement allows the bottles on the base wall 66 to engage at their feet with at least one of the railings 76 to resist minor torque exerted on the bottles which torque otherwise rotate the bottles about their respective upright longitudinal axes.

The above channel 64 may be extrusion-molded from any low friction material, however, the unit is preferably formed of a plastic material such as polyvinyl chloride, polystyrene and the like. Among these plastic materials, the most preferred material for manufacturing the channel 64 is high impact polystyrene. Such polystyrene may have silicone or some other suitable lubricant material dispersed therein in order to reduce friction between the railings/ribs 76 and 86 and the bottles to be disposed thereon.

In order to locate the channel 64 in position on the support frame, it is necessary to simply insert the front and rear ends of the channel 64 into the channel shaped recesses 102 and 104 (see FIG. 2) provided by the front and rear elements 50 and 54, respectively. Of course, if required, the channel 64 may be secured to the support surfaces 56, 58 and 60 by suitable fastening means.

The channels 64 thus located on the support frame are tilted downwardly toward its front end. Therefore, when bottles are loaded onto the channels 64 as shown in FIG. 1, there is a natural tendency for rows of bottles automatically to slide downwardly and forwardly so that the leading bottles such as B0 have their sliding movement arrested by the wire stop 62 and normally rest against the front element 50. Also, as the leading bottles are removed from each channel, the remaining bottles are allowed to gravity feed one after another toward the front ends of the channels so as to be easy to access and ready to be dispensed.

During the above sliding movement, the bottles are subject to minor torque due to friction with neighbouring bottles as well as with the respective channel, which tend to rotate the bottles about their respective longitudinal axes. In the channel of the invention, however, the petaloid feet of the bottles are engaged by the railings 76 and thereby rotational movement of the bottles are prevented effectively. With the bottles each having five petaloid feet, one of the feet of each bottle is received in the groove 80. On the other hand, with the bottles each having six petaloid feet, a pair of diametrically opposed feet of each bottle are received in the groove 80. An example of the bottles with six petaloid feet is illustrated in FIGS. 3 and 4 where reference "L" designates one of the diametrically opposed feet.

The railings 76 also function as a guide for facilitating the loading of bottles into the channel 64 with the labels or logos on the bottles facing in a predetermined direction. This is particularly convenient when the invention is used with large sized PET bottles having a body of a squeezed profile. On these squeezed bottles, the logos are printed on the opposed unsqueezed cylindrical faces only. An example of the squeezed bottles is shown in FIG. 3 in which reference numeral 90 denotes the billboard area on which the logos are printed.

It should be recognized that when the channel 64 is loaded with non-petaloid articles, the lips (i.e., the horizontally extending portions) of the railings 76 can be resiliently flexed downwardly due to the load of the bottles. When flexed, the tops of the railings 76 are lowered to the plane and thereby do not interfere with smooth sliding movement of the non-petaloid bottles. In other words, the channel of the invention can accommodate not only the petaloid bottles but also articles with varying bottom shapes including star, champagne, and scalloped configurations. This also includes the shapes provided by base cups which fit on the bottoms of articles.

Figure 5:
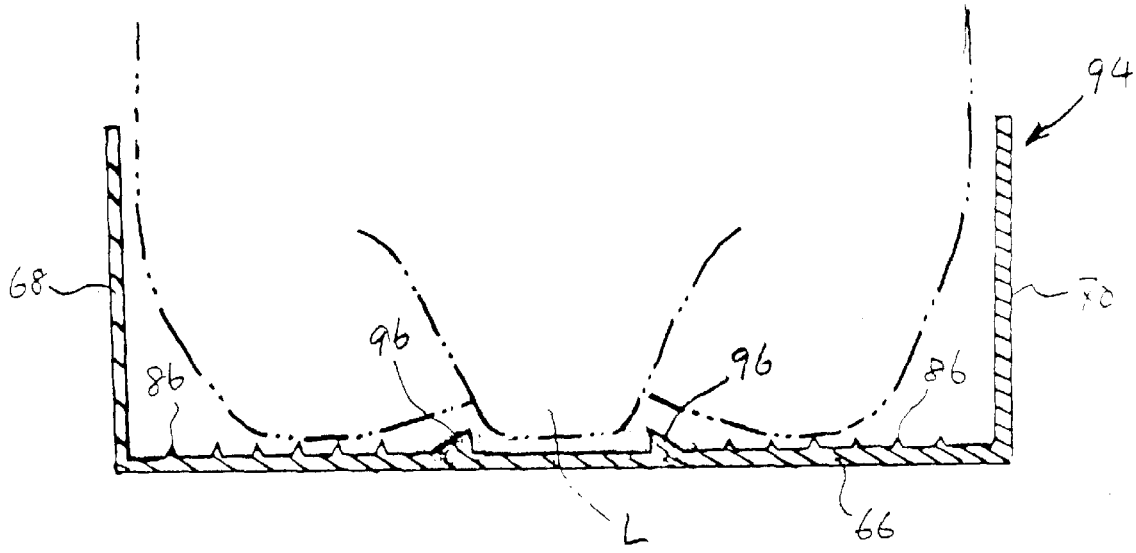
Figure 6:
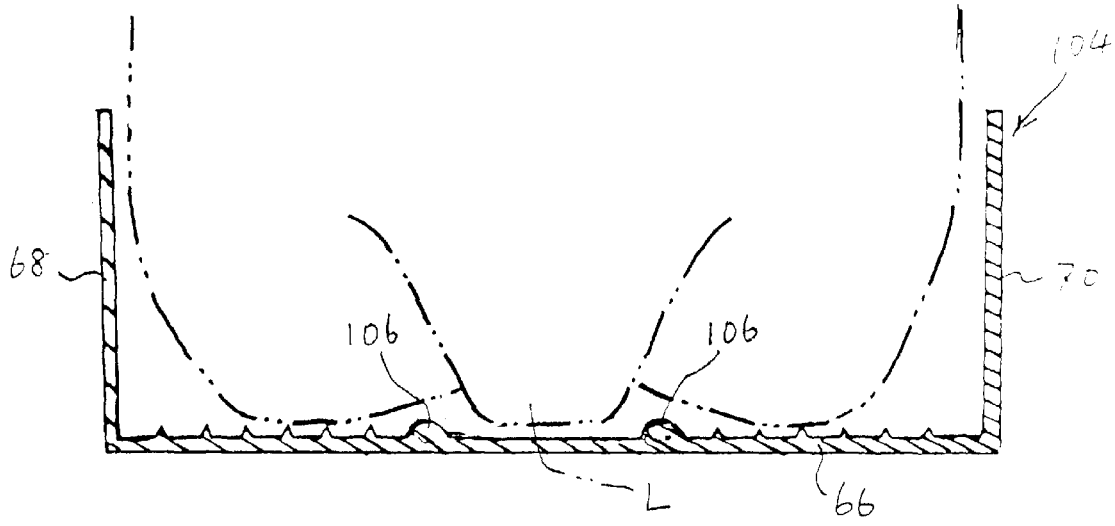

FIGS. 5 and 6 illustrate variations or modified forms of the channel 64. The channel 94 in FIG. 5 has railings 96 of a generally triangular cross section whereas the channel 104 in FIG. 6 has railings 106 of a generally semicircular cross section. The other portions of the channels 94 and 104 are virtually identical to those of the channel 64, and thus like reference numerals are used to indicate the corresponding portions.

Figure 7:
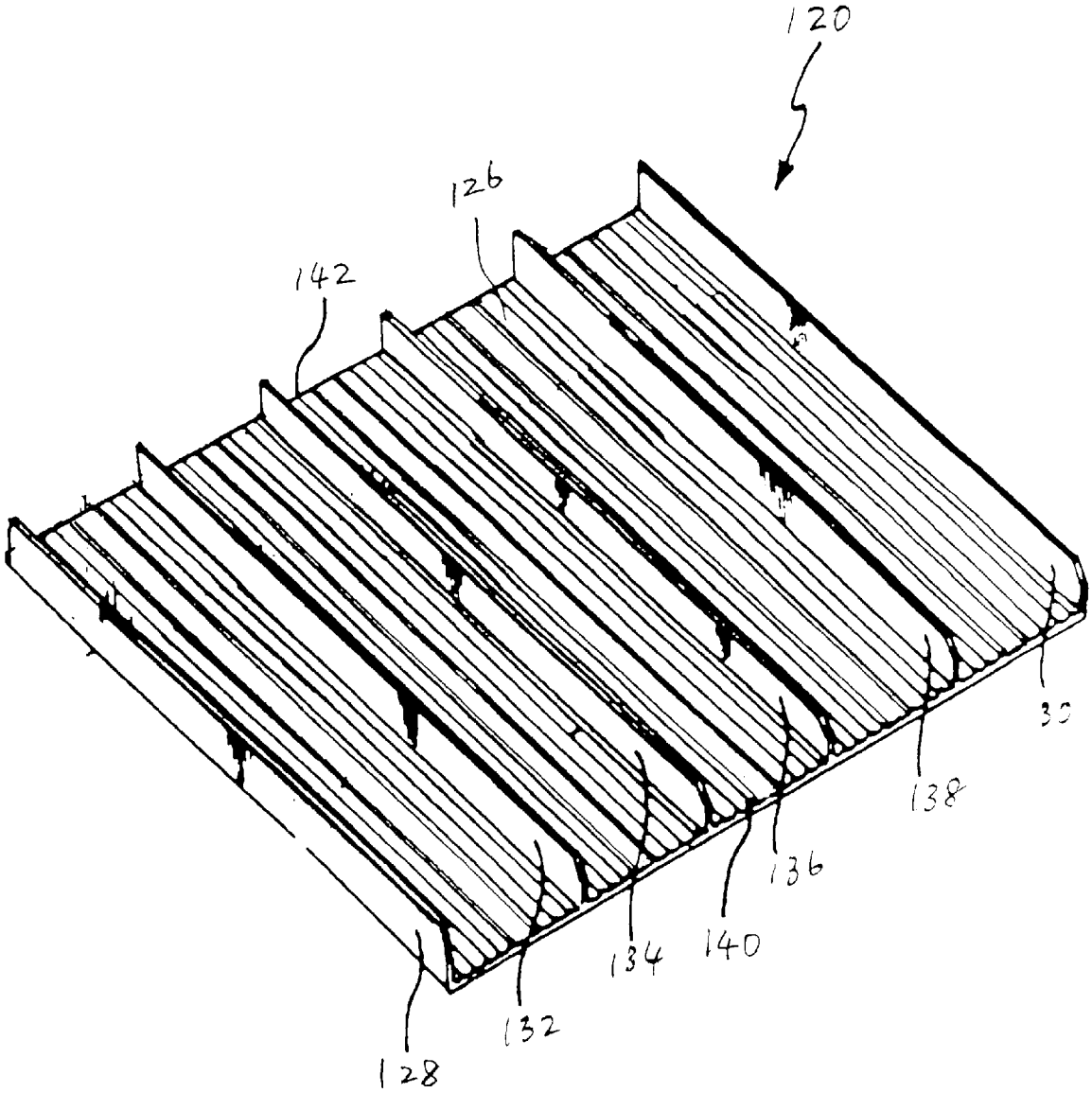
FIG. 7 is a perspective view of a shelf unit which may be used in the shelf device in FIG. 1.

FIG. 7 illustrates a shelf unit 120 which may be used in place of the channels 64. The shelf unit 120 is shown in the form separated from the support frame in FIGS. 1 and 2. As illustrated, the shelf unit 120 includes a floor panel 126 and a pair of end partition walls 128 and 130 upstanding from the opposite side edges of the floor panel 126. The partition walls 128 and 130 extend entirely along the respective side edges. The unit 120 also includes a series of equally spaced parallel intermediate partition walls 132, 134, 136 and 138, which are parallel to the end partition walls 128 and 130. These intermediate partition walls also extend all the way between the front and rear opposed edges 140 and 142 of the floor panel 126. Preferably, the shelf unit 120 is molded from a plastic into a one-piece structure.

The intermediate partition walls divide the space between the end partition walls 128 and 130 into a plurality of tracks extending between the front and rear edges 140 and 142. In other words, each track is defined by the respective pair of adjacent partition walls and the floor panel 126. The partition walls 128, 130, 132, 134, 136 and 138 act as guides for bottles on the shelf unit 120 and cause the bottles placed on the shelf unit 120 to be arranged in parallel rows, each row of bottles being received in the respective track For each track, a plurality of ribs and railings similar to those in FIG. 4 are provided.

It will be recognized that many variations may be made to the foregoing within the scope of the present invention. For example, channel 64 may have only one side wall upstanding from one of the opposite side edges of the base wall 66 so that the channel has a L-shaped cross section. Such L-shaped channels are placed side by side on the support frame so that the sole side wall of each channel is shared with the adjacent channel. An example of the L-shaped channels is disclosed in U.S. Pat. No. 4,496,037 owned by the assignee of the present invention which patent is hereby incorporated by reference.

It should be also recognized that the channel and the shelf unit of the invention may be placed or fixed on a horizontal support frame to provide a non-gravity feed display shelf.

Figure 8:
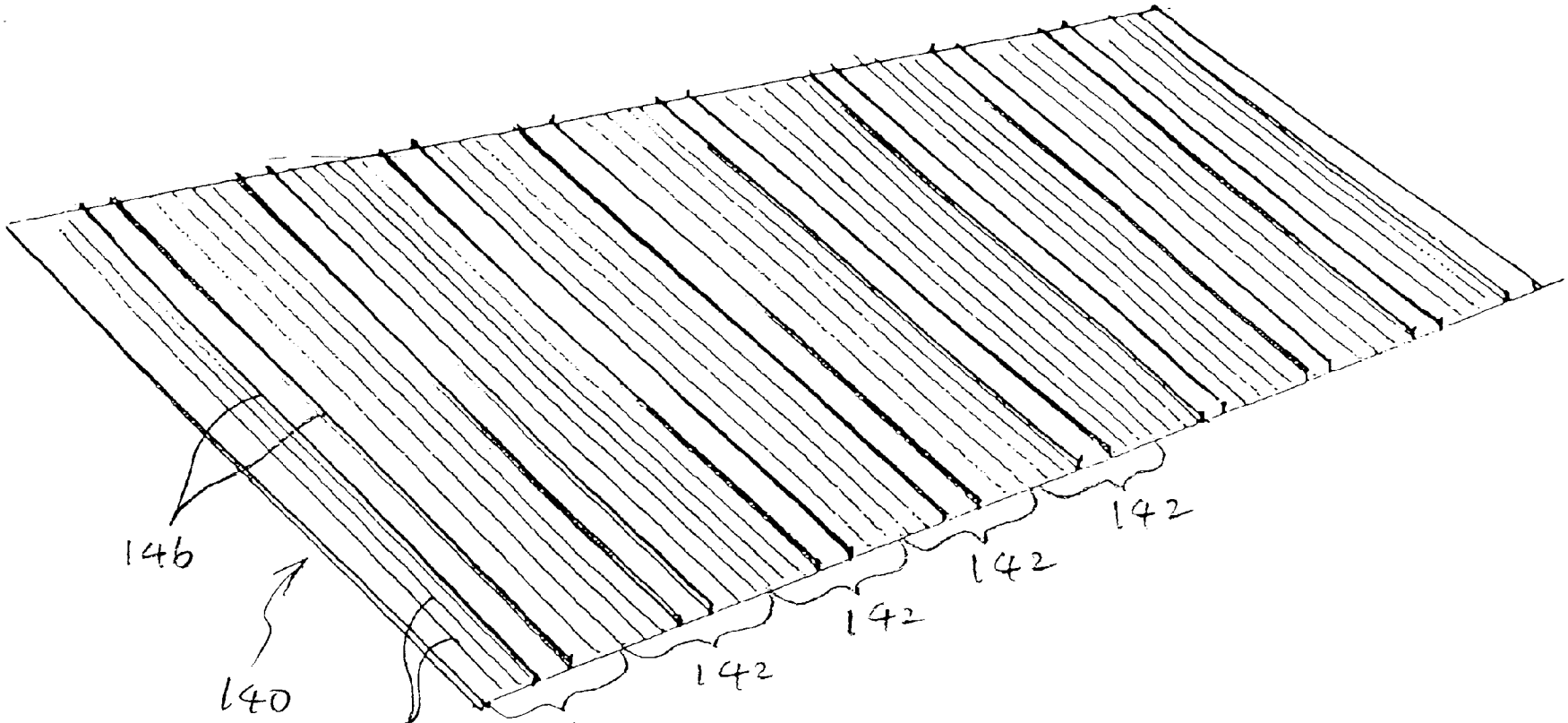
FIG. 8 is a perspective view of an article support sheet according to the present invention.
Figure 9:
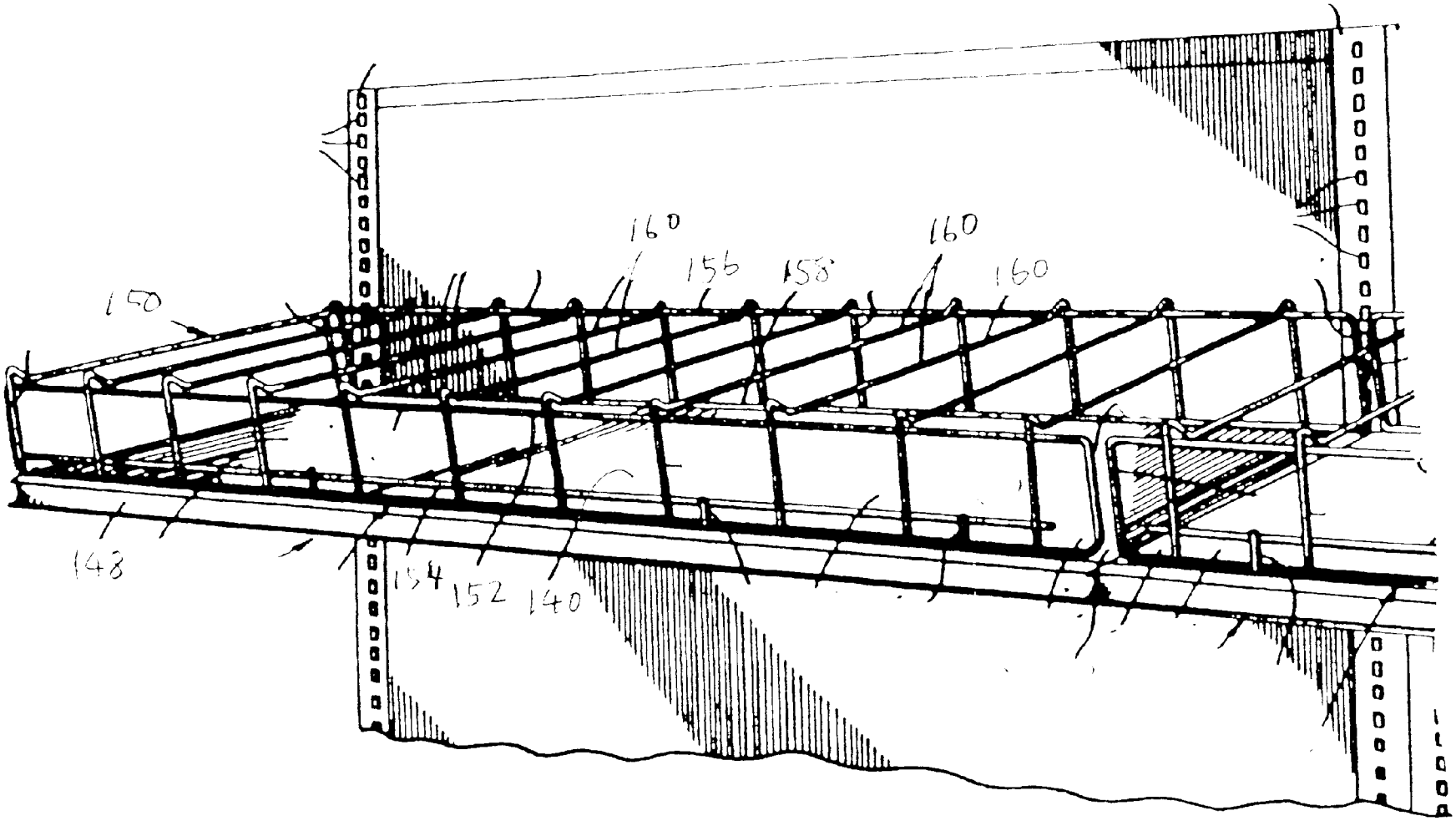
FIG. 9 is a perspective view of a display shelf device having the support sheet in FIG. 8.

It should be further recognized that the present invention may be incorporated into an article support sheet 140 such as shown in FIG. 8. The sheet include a plurality of elongate parallel base wall strips 142 arranged side by side and joined together to form a unitary structure. Each base wall strip 142 include ribs 144 and the railings 146 extending along the respective strip 142 similarly to those shown in FIGS. 3 and 4. As shown in FIG. 9, the sheet 140 is placed on the support frame 148 which is similar to the support frame in FIG. 1 and provided with a wirework 150 including front transverse members 152 and 154, rear transverse members 156 and 158, and a plurality of longitudinal partition members 160. The wirework 150 defines a plurality of tracks extending along the base wall strips 142 respectively so that each track can receive a row of articles for movement along the respective base wall strip 142.

It should be further recognized that the articles useful in the invention are not limited to petaloid bottles but they may be cans having petaloid bottoms.

What is claimed is:

1. An elongate display channel and at least one article, said at least one article having a bottom and a width "w", said display channel comprising:

an elongate base wall having a longitudinal centerline, opposite side edges and at least one side wall upstanding from one of said side edges, said at least one article being positioned between said side edges of said base wall and being slidably movable there between, said side edges being spaced from one another a distance "d" wherein d is greater than w and less than 2w so that said base wall is wide enough for only a single one of said articles;

a plurality of parallel ribs projecting upwardly from said base wall between said side edges and extending along said base wall, said ribs having tops defining a plane, said ribs being arranged in a first group on one side of said centerline and in a second group on the other side of said centerline; and a pair of railings positioned between said first and second groups of ribs, said railings projecting upwardly from said base wall with tops of said railings disposed above said plane and extending along said channel, said railings defining therebetween a groove disposed along said centerline of said base wall and receiving a first portion of said bottom of said at least one article to prevent rotation of said at least one article as a second portion of said bottom of said at least one article contacts said parallel ribs thereby allowing said at least one article to slidably move along said ribs.

2. An elongate display channel and a plurality of articles, each of said articles having a bottom and a width "w", said articles being arranged in a row, said display channel having a front end and a rear end with said front end being at a lower elevation than said rear end, said display channel receiving said row of articles for sliding movement therealong, said display channel comprising:

an elongate base wall extending between said front and rear ends, said base wall having a longitudinal centerline, opposite side edges and at least one side wall upstanding from one of said side edges, said side edges being spaced from one another a as distance "d" wherein d is greater than w and less than 2w so that said base wall is wide enough for only a single row of articles;

a plurality of parallel ribs projecting upwardly from said base wall between said side edges and extending along said base wall, said ribs having tops defining a plane, said ribs being arranged in a first group on one side of said centerline and in a second group on the other side of said centerline with said base wall between said first and second groups being free of said parallel ribs; and a pair of railings being positioned between said first and second groups of ribs, said railings projecting upwardly from said base wall with tops of said railings disposed above said plane and extending along said channel, said railings defining therebetween a groove, along said base wall that is free of parallel ribs, receiving respective first portions of said bottoms of said articles to thereby prevent rotation of said articles, as respective second portions of said bottoms of said articles contact said parallel ribs thereby allowing said articles to slide along said ribs from said rear end to said front end.

* * * * *